US005209555A

United States Patent [19]

Camilleri

[11] Patent Number: 5,209,555

[45] Date of Patent: May 11, 1993

[54] DRAWER AND ROLLER SLIDE COMBINATION

[75] Inventor: Charles Camilleri, St. Louis, Mo.

[73] Assignee: Lee Rowan Company, St. Louis, Mo.

[21] Appl. No.: 857,946

[22] Filed: Mar. 26, 1992

[51] Int. Cl.[5] ..... A47B 88/00

[52] U.S. Cl. ..... 312/334.18; 312/311; 312/334.19

[58] Field of Search ..... 312/334.18, 334.19, 312/334.39, 334.41, 311

[56] References Cited

U.S. PATENT DOCUMENTS

| | | | |
|---|---|---|---|
| 2,142,897 | 1/1939 | Harmon | 312/334.19 |
| 2,941,847 | 6/1960 | Dargene | 312/334.19 |
| 2,997,355 | 8/1961 | Preble | 312/334.18 |
| 3,181,924 | 5/1965 | Guth | 312/311 |
| 3,317,262 | 5/1967 | Vogt | 312/334.19 |
| 4,119,377 | 10/1978 | Barber et al. | 312/334.19 |
| 4,447,095 | 5/1984 | Fielding | 312/334.18 |
| 4,595,247 | 6/1986 | Bank | 312/334.19 |
| 4,666,221 | 5/1987 | Ernst | 312/334.18 |
| 4,995,682 | 2/1991 | Gutner | 312/311 |

FOREIGN PATENT DOCUMENTS

| | | | |
|---|---|---|---|
| 2701879 | 7/1978 | Fed. Rep. of Germany | 312/311 |
| 0262160 | 9/1949 | Switzerland | 312/334.18 |
| 0346988 | 7/1960 | Switzerland | 312/334.14 |

*Primary Examiner*—Victor N. Sakran

*Attorney, Agent, or Firm*—Rogers, Howell & Haferkamp

[57] ABSTRACT

There is a drawer having a bottom, front, rear and left and right side walls. A continuous rim defines left and right upper edge flanges that extend along and connect to the respective upper edges of the left and right side walls. The left and right rim-flanges also define left and right roller tracks. Left and right rollers extend out from the side walls. Correspondingly, there is a set of left and right roller and slide hardware for attaching to a cabinet cavity. Thus, the side flanges defined by the rim also function as components of the drawer's roller slide. The drawer is supported by its flanges and rollers in such operable engagement with the roller and slide hardware that the drawer can slidably travel in a horizontal plane relative to the mounting structure.

19 Claims, 1 Drawing Sheet

DRAWER AND ROLLER SLIDE COMBINATION

BACKGROUND OF THE INVENTION (1) Field of the Invention

This invention relates to a drawer and roller slide combination for slidably supporting a drawer by its sides in a cabinet opening and particularly to such roller slides that are merged into flanges that also function as the upper edges of the drawer side walls.

(2) Description of the Related Art

Drawer-mounting roller slides are well-known in the art. Although some drawer-mounting hardware is designed for installation under a drawer, this invention is an improvement on drawer-mounting hardware of the kind designed for installation on the sides of the drawer. Side-mounted hardware typically comprises a pair of roller and slide brackets for attaching to opposed walls of a cabinet cavity and a second pair of roller and slide brackets for mounting on the outside of the drawer side walls.

Each roller and slide bracket consists essentially of an elongated metal member with a channel cross-section, and a roller rotatably mounted to it. Each channel member is mounted to extend horizontally and to face laterally, and so has upper and lower horizontally extending flanges, one of which will define a slide or bearing surface suitable for the rolling contact of an engaging roller. More specifically, the underside of an upper flange of a drawer-mounted bracket defines a slide or roller bearing surface for the cabinet-mounted roller, as does the upper surface of a lower flange of a cabinet-mounted bracket for the drawer-mounted roller. The drawer-mounted and cabinet-mounted roller and slide brackets operably engage with each other such that the drawer is permitted to travel in a horizontal plane relative to the cabinet between open and closed positions. In addition, the respective sets of roller and slide brackets may be adapted for easy disengagement with one another. Usually, when the drawer is in the extreme open position, it can be disengaged by an upward lift coordinated with an outward pull.

The prior art includes drawers which are fashioned from criss-crossed wires welded together and coated in plastic. These prior art wire frame drawers have proven to be popular because of their low cost and their convenience as a basket. However, there have been some disadvantages associated with these prior art drawers and drawer-mounted roller and slide brackets.

The present invention is an improvement over the drawer and drawer-mounted roller and slide brackets of the type described above. In the present invention, the drawer-mounted slide (roller bearing surface) is merged into a flange that also functions as a rim along the upper edges of the drawer side walls. The advantages of this improvement have resulted in a less costly and more convenient drawer and roller slide combination because the combination is made of fewer components and has lower fabrication costs than the prior art configurations. Moreover, this drawer and roller slide combination weighs less and thus costs less to ship. Further still, the improved drawer nests with other like improved drawers better than the prior art configurations with attached roller and slide brackets, and consequently provides more savings on shipping costs, as well as requires less space in inventory storage locations and retail display shelves.

In addition, since the improvement eliminates the prior art metal channel brackets from the sides of the drawer, this drawer when it has been removed from the cabinet cavity, such as for use as a basket, does not present the typical projections likely to snag garments and the like.

SUMMARY OF THE INVENTION

This drawer and roller slide combination includes a plastic-coated wire drawer that has rim-flanges extending outwardly from the upper edges of the drawer side walls. These rim-flanges are positioned to ride on cabinet-mounted rollers. They replace and eliminate the typical drawer-mounted brackets made of metal channel. More particularly, the drawer has a bottom with a front and back and two opposite side walls, all formed of criss-crossed wires welded together. A continuous, generally rectangular rim is welded to the upper wire ends to complete the basket. The side segments of the rim also function as flanges. A pair of rollers are mounted to the sides of the drawer, near the back. Correspondingly, a roller and slide bracket is attached to each side wall of a cabinet drawer cavity. These metal channel slide brackets include lower horizontal flanges that support the drawer rollers while the rim-flanges on the drawer ride on the cabinet-mounted rollers. The resulting drawer and roller slide combination allows the drawer to travel relative to the cabinet in a generally horizontal plane between open and closed positions.

Moreover, this drawer can be disengaged by being upwardly and outwardly lifted from the open position, and thus released to perform the work of a basket.

Further still, the side walls of the improved drawer diverge outwardly in the upward direction, thus permitting the improved drawer to nest with other like drawers in closely spaced vertical relationships.

DESCRIPTION OF THE PREFERRED EMBODIMENT

Figure 1:
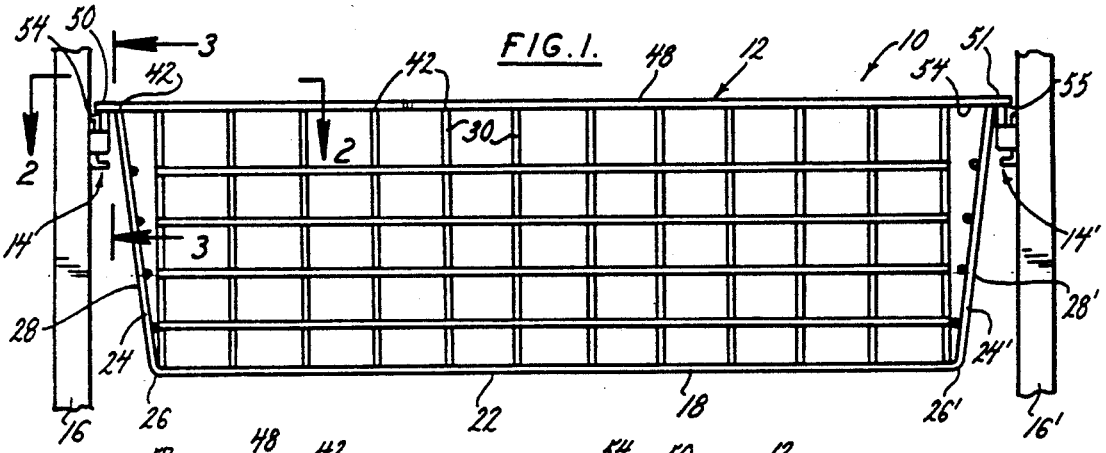
FIG. 1 is a front elevation view of the drawer and roller slide combination with side wall portions of a cabinet cavity shown to illustrate the mounting of the hardware.
Figure 2:
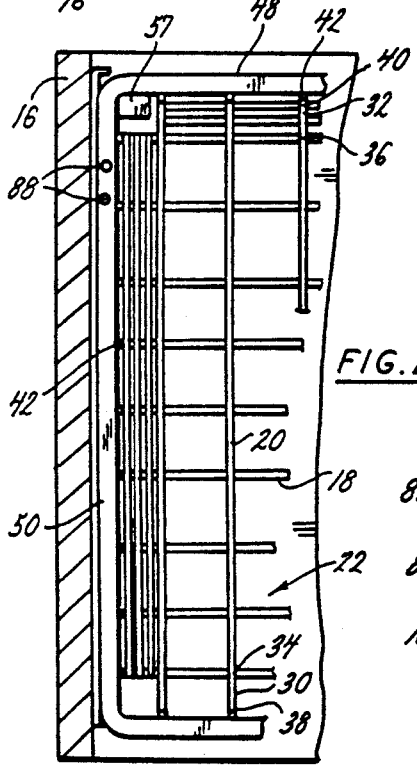
FIG. 2 is a top plan view, with portions broken away, of the drawer and left-side roller and slide hardware.
Figure 4:
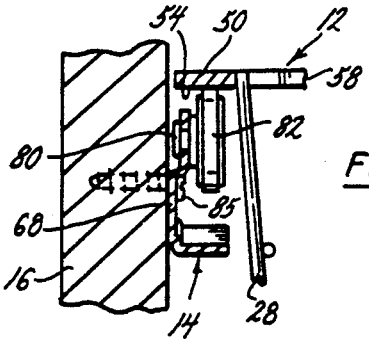
FIG. 4 is a sectional view taken generally along the line 4—4 of FIG. 3.
Figure 5:
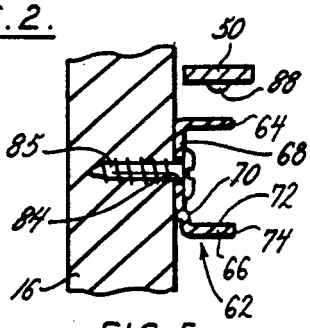
FIG. 5 is a sectional view taken generally along the line 5—5 of FIG. 3.
Figure 6:
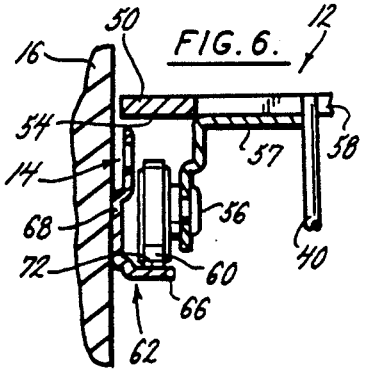
FIG. 6 is a sectional view taken generally along the line 6—6 of FIG. 3.

This drawer and roller slide combination 10 has a drawer 12 supported by and in rolling communication with left and right roller and slide brackets 14 and 14'. The roller and slide brackets 14 and 14' are, in turn, supported by and fastened to the opposed walls 16 and 16' of a cabinet cavity (shown for illustrative purposes only).

The drawer 12 is made up of a transverse set of spaced U-shaped wires 18 disposed on and welded to a longitudinal set of spaced, U-shaped wires 20 to define a drawer bottom 22. Left and right arms 24 and 24' of the transverse wires 18 extend generally upwardly from the left and right bends 26 and 26' at the sides of the drawer bottom. The aligned rows of arms 24 and 24' collectively define left and right drawer side walls 28 and 28' respectively that diverge outwardly in the upward direction. Likewise, there are front and back arms 30 and 32 of the longitudinal wires 20 extending generally upwardly from bends 34 and 36 at the front and back of the drawer bottom 22. The rows of front and back wire arms 30 and 32 collectively define front and back drawer walls 38 and 40 that diverge outwardly in the upward direction. All of the wire arms 20, 28', 30 and 32 terminate in upper ends 42 that are in a common horizontal plane.

A continuous basket rim 48 is formed of plastic coated metal in the shape of an open rectangle. The rim 48 is welded at its inner edge to the upper ends 42 of the wire arms 28, 28', 38 and 40. The rim 48 defines an upper edge for each side wall, and also stabilizes and maintains the span between adjacent wires, as well as between opposite walls 28 and 28', and 38 and 40.

The side segments 50 and 51 of the rim 48 also function as flanges which have lower surfaces 54 and 55 that define parallel roller slides or roller bearing surfaces.

On each side of the drawer 12 adjacent its back, a roller axle 56 is secured to a bracket 57. The bracket 57 positions the axle 56 to extend horizontally and outwardly relative to the respective side walls 28 and 28' Two plastic rollers 60 are rotatably mounted on the axles 56.

The roller and slide brackets 14 and 14' include a sheet metal channel section 62 mounted on the left and right cavity walls 16 and 16' of the cabinet. Each channel section 62 has an upper and lower flange 64 and 66 vertically spaced by an interconnecting web 68. The length of each channel section 62 is generally co-extensive with the length of a rim-flange segment 50 or 51 of the basket rim 48. The vertical spacing between the upper and lower channel flanges 64 and 66 is generally just greater than the diameter of a roller 60. There is a small shoulder 70 where the lower channel flange 66 joins to the channel web 68, which acts as a guide for the drawer-mounted roller 60, to restrain it from undue transverse horizontal movement and from interference with the channel mounting screws.

Each lower channel flange 66 has an upper surface 72 between the small shoulder 70 and an inner edge 74. This upper surface 72 defines a bearing surface for the drawer roller 60.

The length of the channel web 68 and lower channel flange 66 are nearly co-extensive with the length of a rim-flange segment 50 or 51. The length of the upper channel flange 64 is much less, terminating short of the channel front and back ends 76 and 78 by more than two diameters of the drawer roller 60. A roller axle 80 is securely connected to each channel web 68 near the channel front end 76. Each roller axle 80 extends inwardly and supports a plastic roller 82, which is rotatably mounted and is positioned so that it has an upper surface projecting higher than the upper extreme of the upper channel flange 64. The channel web 68 has a series of holes 84 through it, for receiving screws 85 that secure each channel section 62 to a cabinet wall 16 or 16'

The drawer 12 and roller and slide brackets 14 and 14' are operably connected such that the drawer 12 is supported by the rolling contact between the drawer-mounted roller 60 and the surface 72 and by the cabinet-mounted roller 82 and the surface 54. These engagements enable the drawer 12 to travel relative to the cabinet walls 16 and 16' in a generally horizontal plane between extreme open and closed positions.

Figure 3:
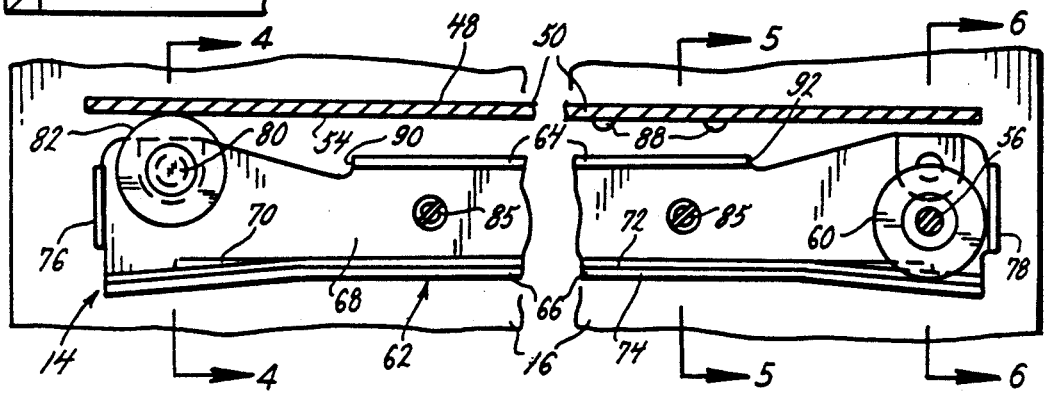
FIG. 3 is an enlarged sectional view taken generally along the line 3—3 of FIG. 1 and with middle portions broken away.

The sliding action of the drawer 12 is stopped in the extreme closed position by two tabs 86, one for each left and right roller and slide bracket 14 and 14'. Each tab 86 is formed from the channel back end 78 of the channel web 68, and extends inwardly to limit the backward travel of the drawer roller 60 as shown in FIG. 3.

Correspondingly, the sliding action of the drawer 12 is stopped in the extreme open or forward position by a pair of longitudinally spaced detents 88 on each of the left and right rim-flanges 50 and 51. Two of the detents 88 are formed on the underside of the rim-flange segment 50 and two detents 88 are formed on the underside of the rim-flange segment 51. The detents 88 delimit the forward travel of the drawer 12 by trapping the cabinet-mounted rollers 82 between them.

The drawer 12 is easily disengaged from the roller and slide brackets 14 and 14' by lifting it upwardly and forwardly when it is in the extreme open position. To facilitate this, as illustrated in FIG. 3, the upper channel flange 64 terminates at a back edge 90 that is short of the channel web front end 76 to define a gap between the edge 90 and the cabinet-mounted roller 82; the drawer roller 60 will fit through that gap. The upper channel flange 64 also terminates at an edge 92 that is just as short of the channel web back end 78 as the front edge 90 is short of the channel web front end 76.

From the foregoing description it is apparent that the rim 48 on the drawer doubles in function as a component of the roller slide. This eliminates the requirement for separate elongated channels or brackets to be attached to the sides of the basket for riding on the cabinet-mounted rollers 82. Consequently, material and labor are saved. Also, in the absence of such channels or brackets on its side, the basket can be somewhat wider, increasing its capacity.

Since the basket-mounted rollers 60 are just below the rim 48, the basket 12 will nest with a like basket, with its rollers 60 resting on the rim 48 of the lower basket.

While the present invention has been described by reference to a specific embodiment, it should be understood that modifications and variations of the invention may be constructed without departing from the scope of the invention defined in the following claims.

What is claimed is:

1. A drawer and roller slide combination including mounting hardware for supporting the drawer in sliding relation to a mounting structure, comprising:

a drawer having at least two opposite side walls for retaining articles;

each side wall having an upper rim and an upper margin adjacent the upper rim, the upper rim providing a generally horizontal bearing surface positioned to ride on a roller;

the upper margins of the side walls gaining stiffness from the upper rims;

a pair of first rollers supported by the drawer;

a pair of roller slides and second pair of rollers for attaching to the mounting structure;

the lengths and orientations of the bearing surfaces and roller slides permitting continual rolling contact between the bearing surfaces and the second rollers and continued rolling contact between the roller slides and first rollers when the drawer slidably travels relative to the mounting structure in a generally horizontal plane between open and closed positions.

2. The combination in claim 1 wherein:

the lengths and orientations of the bearing surfaces and roller slides further permit the drawer to be disengaged when lifted upwardly and outwardly from the open position.

3. The combination in claim 1, wherein:

the side walls diverge outwardly in the upward direction, and the first rollers are connected to the drawer at locations permitting the drawer to nest with other like drawers in closely spaced vertical relationships.

4. The combination of claim 1, wherein:

the drawer has front and rear walls of the same height as that of the side walls.

5. The combination of claim 4, wherein:

the drawer is generally made of crisscrossed wires defining the bottom, front, rear and side walls, the wires terminate in exposed ends defining the upper edges of the walls, and the upper rims of the side walls are integrally part of a continuous rim element that extends along all four upper edges and that connects to the wires to provide stability and maintain the span between opposite walls.

6. The combination of claim 5, wherein:

the continuous element is metal, and the connections are welded joints.

7. The combination of claim 6, wherein:

the continuous rim element defines the bearing surfaces.

8. The combination of claim 7, wherein:

the continuous rim element is a metal flange generally less than ½ inch wide.

9. A drawer and roller slide combination including mounting hardware for supporting the drawer in sliding relation to a mounting structure, comprising:

a drawer having a plurality of spaced apart, elongate first elements and a plurality of spaced apart, elongate second elements disposed transverse to and connected with said first elements to define a bottom;

said first elements being generally U-shaped and having left and right outer portions extending generally upward form the side margins of said bottom to define left and right spaced apart side walls with the ends of said portions in a common plane at the tops of the side walls;

a left element and a right element extending horizontally along and connecting to the ends of the respective left and right outer portions for stabilizing the spacing among the upwardly extending outer portions and for defining left and right roller tracks;

left and right first rollers connected to the drawer;

left and right means and left and right second rollers for attaching to a mounting structure; and the left and right elements and second rollers being in engagement and the left and right means and first rollers being in engagement for supporting the drawer so that the drawer can slidably travel relative to the mounting structure in a generally horizontal plane between open and closed positions.

10. The combination of claim 9, wherein:

the lengths and orientations of the left and right elements and the left and right means permit the drawer to be disengaged when lifted upwardly and outwardly when in the open position.

11. The combination in claim 9, wherein:

the side walls diverge outwardly in the upward direction, and the first rollers are connected to the drawer at locations permitting the drawer to nest with other like drawers in closely spaced vertical relationships.

12. The combination of claim 9, wherein:

the left and right elements respectively comprise left and right elongate flange segments.

13. The combination of claim 12 further comprising:

a continuous element having front and rear segments which are respectively merged with the left and right elongate flange segments, wherein said continuous element at least provides for stabilizing and maintaining the span between the left and right side walls.

14. A drawer and roller slide combination comprising:

a drawer which comprises a wire frame bottom portion that extends laterally between spaced left and right side edges, left and right side walls that include a plurality of spaced parallel wire segments extending up from the left and right side edges to upper ends, and left and right flange portions elongated in the front to back direction and secured to the upper ends of the wire segments of the left and right side walls to hold the upper ends in fixed relative positions;

a left and a right outwardly disposed roller supported by the drawer; and a left and a right bracket for attaching to a mounting structure, each bracket including a roller slide and supporting an inwardly disposed roller;

wherein the drawer is supported for movement between relatively closed and open positions by rolling engagements between the outwardly disposed rollers and the roller slides and between the inwardly disposed rollers and the flange portions.

15. The combination of claim 14 wherein:

the flange portions are secured to the wire segments by means of welded joints.

16. The combination of claim 14 wherein:

the flange portions are a left and a right segment of a hoop element comprising the left and the right segments and a front and a back segment.

17. The combination of claim 14 wherein:

the flange portions include planar lower surfaces for rolling engagements with the inwardly disposed rollers.

18. The combination of claim 14 wherein:

the side walls diverge outwardly in the upward direction, and the outwardly disposed rollers are supported by the drawer in positions permitting the drawer to nest with other like drawers in closely spaced vertical relationships.

19. The combination of claim 14 wherein:

the lengths and orientations of the flange portions and the brackets permit the drawer to be disengaged when lifted upwardly and outwardly when in the open position.

* * * * *